United States Patent [19]

Rose

[11] 4,106,111

[45] Aug. 8, 1978

[54] CONCRETE MAKING AND TRANSMISSION

[76] Inventor: Leo J. Rose, Reston, Va. 22091

[21] Appl. No.: 785,716

[22] Filed: Apr. 7, 1977

[51] Int. Cl.[2] ..... B28C 5/38

[52] U.S. Cl. ..... 366/3; 366/10; 366/114; 366/124

[58] Field of Search ..... 259/147, 151, 4 R, 18, 259/36, DIG. 43; 366/3, 5, 10, 11

[56] References Cited

U.S. PATENT DOCUMENTS

| | | | |
|---|---|---|---|
| 1,024,221 | 4/1912 | Osgood | 259/151 |
| 1,185,118 | 5/1916 | MacMichael | 259/147 |
| 1,755,329 | 4/1930 | McCormack | 259/151 |
| 2,534,116 | 12/1950 | Fjeldstad | 259/151 |
| 3,194,539 | 7/1965 | Hanne-Wiame | 259/151 X |
| 3,582,046 | 6/1971 | Mueller et al. | 259/4 R |

FOREIGN PATENT DOCUMENTS

| | | | |
|---|---|---|---|
| 551,485 | 1/1923 | France | 259/151 |
| 2,426,894 | 12/1975 | Fed. Rep. of Germany | 259/151 |

*Primary Examiner*—Philip R. Coe

*Attorney, Agent, or Firm*—Misegades, Douglas & Levy

[57] ABSTRACT

Concrete is manufactured by mixing cement with substantially the exact precise quantities of water needed to produce a setting of the cement, agitating the mixture until its viscosity is substantially reduced, adding dry sand or other agrigate, mixing with a slurry, patting the mixture through a nozzle where air is introduced under a pressure and air is emitted in the form of jets into the tapering part of the nozzle, and the mixture is vibrated to achieve maximized distribution of its components while being blended and recombined during the process of gunning and feeding to the location of distribution. The concrete mix may be applied appropriately to a gun assembly or a gun type device designed dispense entrained granular materials in a compressed stream onto a work area.

8 Claims, 5 Drawing Figures air
24a
22a
20a
30

10
12
16
14
18
22
24
20
32
30
33
34
36
40
41
43
43
44
48
50
52
60
62
64
70
76
78

FIG. 3
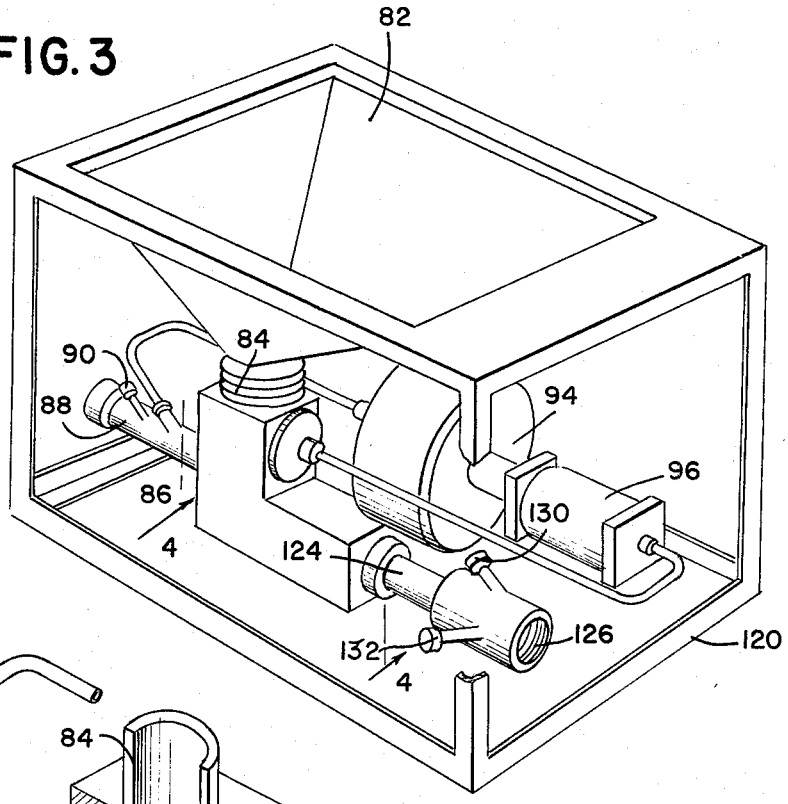
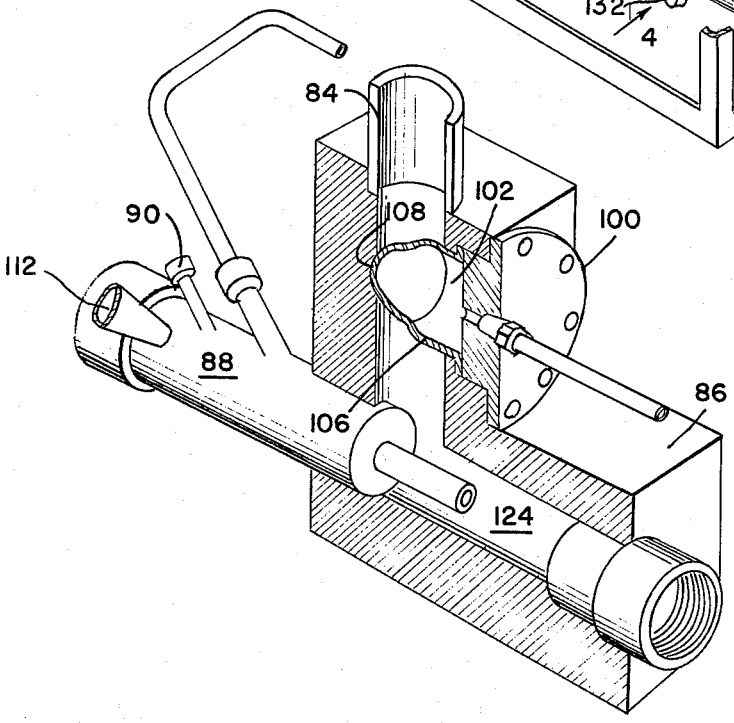
FIG. 4

CONCRETE MAKING AND TRANSMISSION

CROSS-REFERENCE TO RELATED INFORMATION

There are found of general interest in Class 259, Subclasses 147 and 151, among other Subclasses, patents to Anderson U.S. Pat. No. 2,779,519 and Cornwell U.S. Pat. No. 3,669,417. Each of these patents do not show the combination that is set out in a system of mixing, including a hopper, a material control valve, a pop, flapper and nozzle, combinations, vibrator, and a gunning or distribution means for distributing the cement to the location where it is to be used.

BRIEF SUMMARY OF THE INVENTION

The invention relates to new and improved methods of making improved concrete and apparatus therefor, and more particularly relates to means and steps of mixing cement with exact amounts of water, agitating it until its viscosity is substantially reduced, adding sand and aggregate as proper, and then pumping it through pressure to a nozzle and vibrating the contents so that there is complete miscibility, and there is improved thereby a composit mixture of cement not found in any other prior art.

It has long been a problem that air forced into pipes or in the conduits for apportionment of cement mixtures in conduits, pipes, hoses and the like have not always provided the best distribution of cementitious mixtures. One of the features of this invention is that it relates to improved methods of apportionment of cememtitous mixtures and blends of cement along hoses, pipes, conduits and the like by aiding such flow by the use of vibrators, and infusion of air by an venturi element, and by the practice as further described and shown in the present invention.

FIELD OF THE INVENTION

One of the objects and advantages of the present invention is to provide a new and improved apparatus for making concrete and for conveying it to the job location by a hose, conduit or the like, which is connected to an air-driven vibrator means.

It is also an object and advantage of the present invention to provide a new apparatus within the purview of this invention in which air pump means receives air from a compressor and feeds air to the venturi means for the admixture of air and the blend of cement, and for providing air by the air pump for feeding and aiding the conveyance of the admixture of air and said blend of cement along a conduit leading to a nozzle.

It is further object of the invention to provide vibrator means for mechanically vibrating the conduit and carrying a blend of cement and air to a nozzle or others for exhausting or exiting the cement blend to the load and/or the use means.

Also within the purview of the present invention is to provide an object and advantage of interposing a flapper valve element and a material control valve disposed operatively within a conduit means between a hopper and a chamber where the air is mixed with the cement by means of a venturi means.

A BRIEF DESCRIPTION OF THE SEVERAL VIEWS OF THE DRAWING

The above and other objects and advantages of the invention will become apparent upon full consideration of the following detailed description and accompanying drawings in which:

FIG. 3 shows a partially broken away perspective view of a hopper and entraining apparatus according to a modification of the present and preferred embodiment of the invention;

FIG. 4 shows in detail and enlarged perspective view of the injector and pump body of FIG. 3 taken along line 4—4 of FIG. 3.

DETAILED DESCRIPTION OF A PREFERRED EMBODIMENT OF THE INVENTION

Figures 1, 2:
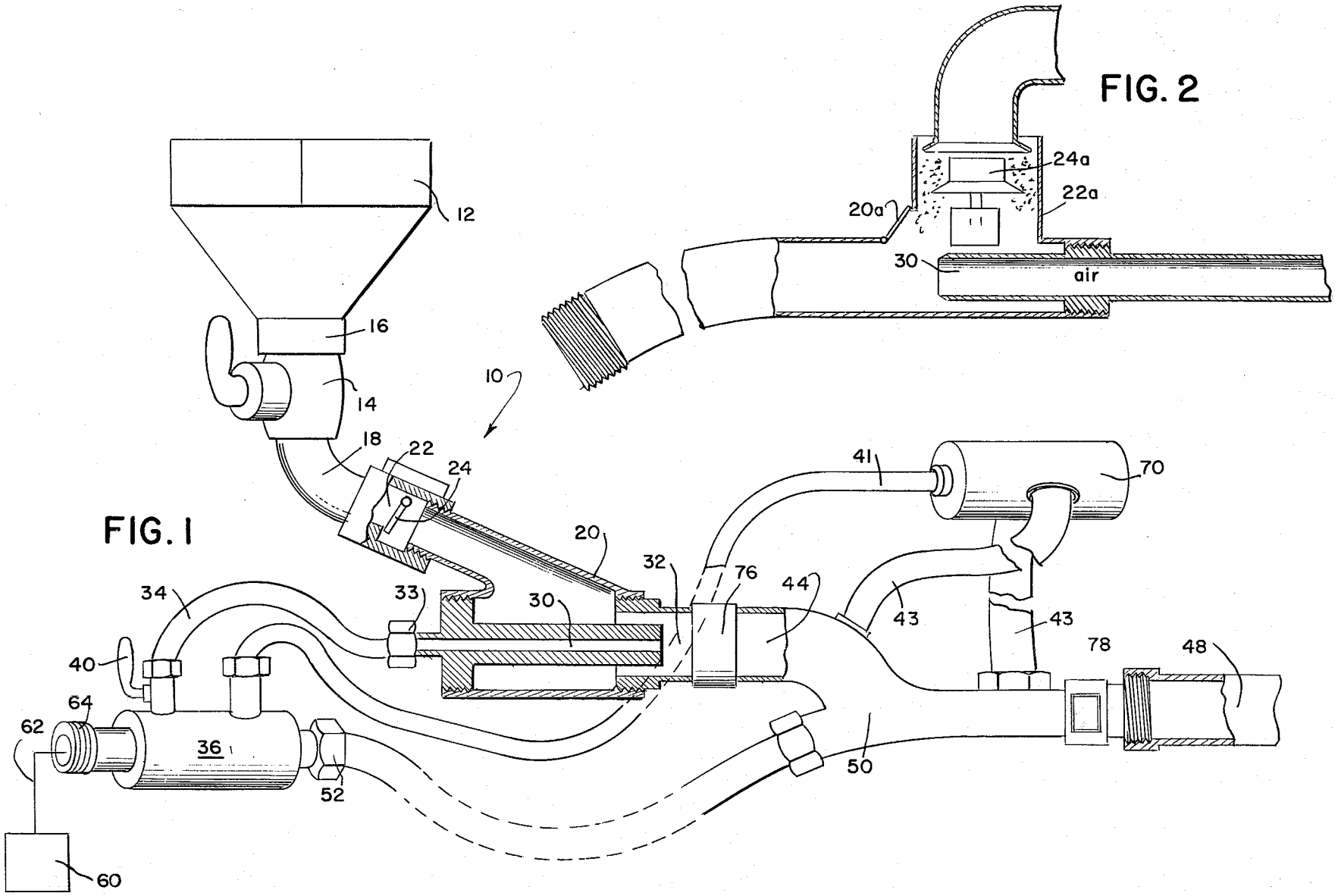
FIG. 1 shows schematically and in partial broken-away view an arrangement of a new apparatus for making improved concrete and the like, according to a preferred and best mode of the present invention.
FIG. 2 shows an enlarged view of a valve for closing off the back flow of cement as a modification of valve 24 of FIG. 1 according to another preferred embodiment of the invention.

Referring now to the drawings there is shown a system or apparatus 10, a material hopper 12, an exit 16 for gravity feed of cement mix, water, aggregate and the like from the hopper to a material control valve 14 through the exit 16, an elbow coupling 18, and a TEE inlet and chamber arrangement 20 coupled to the elbow 18 for directing the blend of cement mix into the chamber 20. Within an entrance portion 22 of the chamber 20 there is arranged and disposed a flapper valve element 24 for eliminating back-flow of the blend of cement mix from returning through the elbow 18. Within the chamber 20 and disposed for allowing maximized mixing with the blend of cement is a Venturi element 30 having its free and extending into the outlet portion 32 of the chamber 20 for introducing in a maximizing relation an amount of air fed through the Venturi element 30 which is coupled to it at a coupling fixture 33, which is connected to a hose 34 and then to an air pump 36. A valve 40 for controlling the rate of air flow through the hose 34 provides for the amount of air fed to the Venturi element 30. By the Venturi effect of the element 30 in the exit portion 32 of the chamber 20, there is added a mix of a given amount of air blend of cement within the hose conduit 44. The hose conduit 44 may be a flexible and resiliently constructed hose structure for conveying and feeding concurrent blend of air and cement up to a nozzle mounted or mechanically coupled at the end of the hose 48. In order to provide for apportionment of the air and cement blend along the hose 44 and 48, air is injected under pressure through a Tee coupling 50 having its inlet end 52 coupled to the pump 36 and thus provides air under significant pressure to the Tee element 50.

The pump 36 may be fed from a conventional type air compressor unit 60 by a conduit means 62 fed to the intake 64 of the pump 36.

There is another coupling from that pump 36 for leading or feeding air by hose 41 from the pump 36 to an air-driven vibrator motor or element 70 which is mechanically coupled by structures or members 43,43 to one or more portions of the hose 44 for vigorously vibrating the hose 44 and aiding in the mixing process of combining and recombining air with the blend of cement mix. One, two, or more couplings or vibrating applications of the vibrator element 70 may be made to the hose between the chamber 20 and the nozzle at the free end of the hose 48.

By means of the apparatus and the method of the foregoing novel arrangement described and disclosed there is provided a nozzle free end of the hose 48 for spraying or gunning a concrete mix or blend of cement, aggregate, some water, sand and the like, in a cementitious mixture and a blend of components that may be disposed in a useful manner in the operation of spraying or gunning the concrete into the given location desired.

One of the advantages and benefits of the present invention is that transparent portions of the pipe or hose 44 may be provided so that the user of the apparatus on the job location may view through the transparent piping or tubing along the length of the hose 44 for observing the degree and completeness of the blend of cement mix and air prior to its being sprayed from the gun or nozzle at the free end of hose 44. In this way there is provided some saving and useful disposal of the material forming the cement mix blend and the adjustment of the valve 40, 14, 24, and others are that may be provided in the air compressor, the amount of vibration effected by the vibrator element 70, may be vigorously and mutually controlled for aiding and assisting the adjustment of the blend of cement mix fed in the hopper 12 which is disclosed from the nozzle at the free end of hose 48. These window elements 76, 78 are shown in the figure to be appropriately interposed in the hose 44 as shown.

There is shown in FIG. 2 a modification and a departure from the construction of FIG. 1 and in which the chamber 20*a* is provided with a nozzle 30; about the entrance portion 22*a* is arranged and disposed for having a plunger type, solenoid operated valve element 24*a* for closing off the flow of blend of cement from the hopper 12 (not shown).

The invention is used for combining and mixing refactory castable mixes, dry bagged concrete mixes, and special mixes that have been previously kiln dried that require water prior to gunning. Water and the mix are introduced into the hopper in quantities that will mix these materials into a state of mix ideal for gunning or into a slurry when it is required. By means of the present invention air is added also to drive the stream to a gun element (not shown). Variable speed output is achieved and so enabled by the operator in the control of the stream flow by the apparatus of the present invention. FIGS. 3 and 4 more particularly show this feature for providing even flow and quick adjustment of the constituency thereof by the automatic means.

These FIGS. 3 and 4 in part show a hopper 82, an isolator 84, a pump body 86, an air needle chamber 88 having an air needle/water injector line 90, and a vacuum sensor line 92 coupled to the air needle chamber 88.

The vacuum sensor line 92 is a retro sensor transfer means that is shown in FIG. 3 to be coupled at its source end to an air cylinder amplifier 94 driving a hydraulic intensifier means 96 for in turn driving an air valve retainer 100 coupled to an air chamber 102 within the hopper-stream forming path from the isolator 84. There is a bladder element 106 for filling the air chamber 102 when it is inflated, and which allows passage of the material in the path in isolator 84 when partially or inflated at a minimum valve. FIG. 4 shows the bladder element 106 in full inflation state and forming a bladder valve 108 with the isolator 84. The valve effect of valve retainer provides control of the state of operation and control of the bladder valve. The hopper 82 may be appropriately mounted and constructed for vibration as shown as well known in the art. Some water may be added to the chamber of the air needle 88 by inlet 112.

Figure 5:
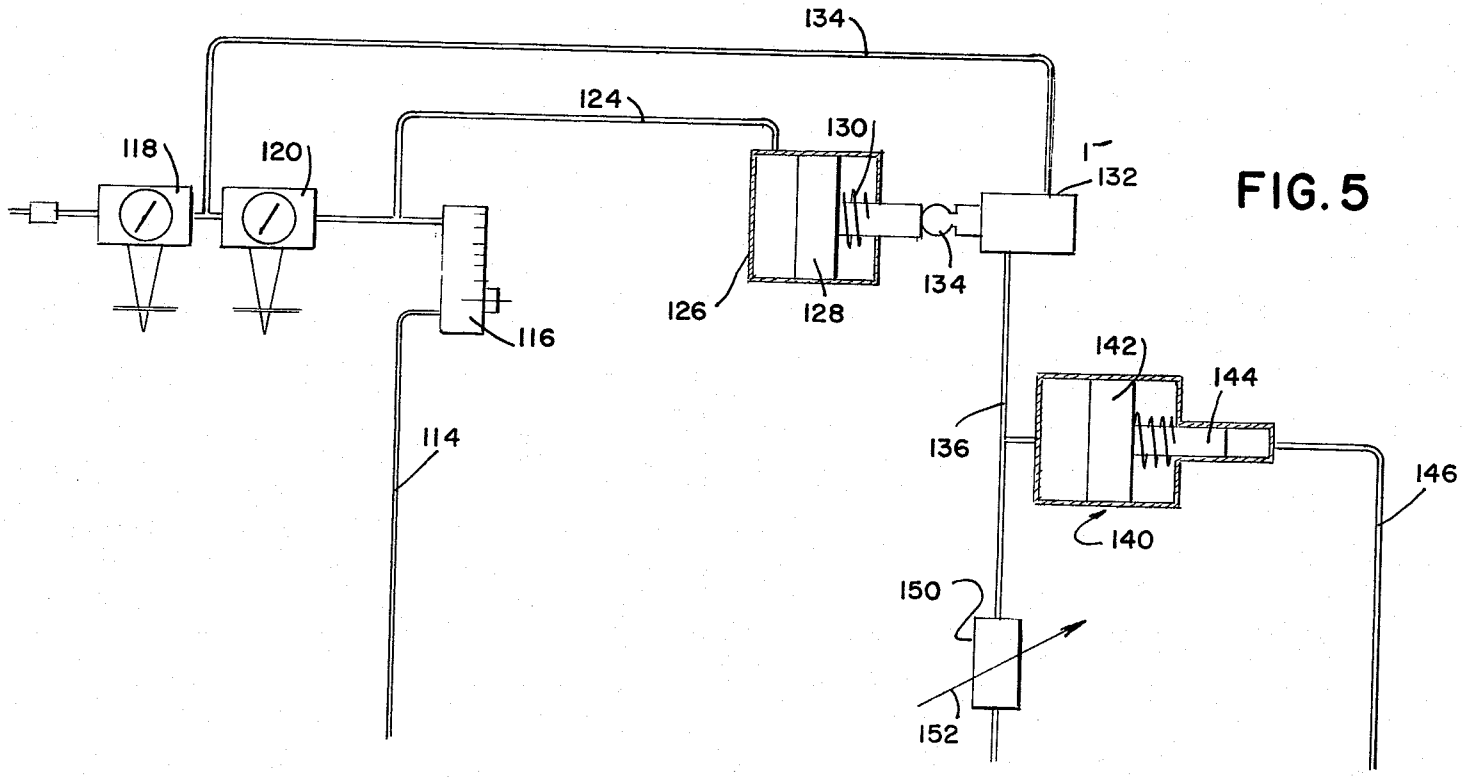
FIG. 5 is a flow chart diagram showing sensor control and regulation of the system of the concrete mixing apparatus of the invention.

The arrangement of the invention is provided with a sensor system such as that illustrated in FIG. 5 as used in connection with FIG. 4.

An air source is applied to line 110; water is inserted at 112. Air bleeds (normally) from line 114 into line 110, unless there is back up caused by stoppage in the line. Line 114 is coupled to flow meter 116 which in turn is coupled to regulators 118, 120 each of which are intercoupled; regulator 118 is coupled to air intake coupled to air in line 110 (not shown) or some other source (not shown). Line 124 is coupled from joint with flow meter 116 and regulator 120 to air cylinder or valve 126 having sliding piston 128 biased by our load spring 130 for opening valve or mechanical air valve 132 by a mechanical coupling 134 so that the coupling 134 opens the valve 132 for passage of air from line 134 to line 136; and conversely coupling 134 closes the valve 132 for cutting off the air from line 134.

Air amplifier cylinder 140 has a large piston 142, a small piston 144, and a hydraulic output line 146 driven by the small piston 144, in response to air pressure valves in line 136.

A bleeder valve 150 with an adjustment means 152 for adjustments of the rate of bleeding of air from line 136 provides control of this air pressure in line 136 and thus controls the amount of amplification in the amplifier cylinder 140. Line 146 converts its hydraulic medium to the bladder valve 108.

The entire assembly is constructed to be positioned within a frame 120 and the controlled mixture of the stream of material entrained by the pump passes with regulation through a pipe 124 and an air slugger chamber 126 which is coupled to two (or more) air pressure inlets 130, 132 for directing and mounting the mixture forward to a gun (not shown).

Additional embodiments of the invention in this specification will occur to others and therefore it is intended that the scope of the invention be limited only by the appended claims and not by the embodiment(s) described herein above. Accordingly, reference should be made to the following claims in determining the full scope of the invention.

What is claimed is:

1. Concrete making and transmission apparatus comprising a chamber, a hopper for receiving a blend of cement mix, water and aggregate in an amount to produce a setting of the cement, conduit means for conveying the blend of cement from the hopper to said chamber, a nozzle, a transmission conduit coupling said nozzle to said chamber, said chamber having a Venturi means having an orifice and centrally extending within said chamber with its orifice disposed at a location for exiting of the blend of cement from said chamber to said transmission conduit leading to said nozzle, an air compressor means, an air pump means for receiving air from said air compressor means, said air pump having first conveyance means connected thereto for feeding air to said Venturi means for the admixture of air and said blend of cement, a second conveyance means connected to said air pump for feeding air to said transmission conduit leading to the nozzle for pushing and aiding the conveyance of the admixture of air and said blend of cement along the transmission conduit leading to the nozzle, a vibrator element for mechanically vibrating the transmission conduit leading to the nozzle, and a third conveyance means connected to said air pump for feeding air from said air pump for driving said vibrator element.

2. The invention of claim 1 wherein a material control valve is interposed in the path between said hopper and said chamber within said conduit means.

3. The invention according to claim 1 wherein a flapper valve element is in said conduit means for preventing back flow of said blend of cement.

4. The invention of claim 3 where a material control valve is disposed operatively within said conduit means upstream of said flapper valve element.

5. The invention of claim 1 wherein a window element of transparent material is mounted in the conduit leading to the nozzle for observing the degree of miscibility of the blend of cement mix and air within the conduit.

6. The invention according to claim 1 wherein a plunger type valve being operable upon energization of a solenoid or free flow of the blend of cement is disposed in an entrance portion of the chamber for preventing back flow of the blend of cement.

7. The invention of claim 1 wherein said chamber is provided with a bladder valve for selectively closing and opening the chamber for passage of aggregate thereto and wherein air amplifier means controls the disposition and regulation of air passing through said chamber.

8. Improved method of making and transmitting concrete comprising receiving a blend of cement mix, water and aggregate in an amount to produce a setting of the cement, conveying the blend of cement to a chamber, said chamber having a Venturi means having an orifice and centrally extending within said chamber with its orifice disposed at a location for exiting of the blend of cement from said chamber to a transmission conduit leading to a nozzle, pumping compressed air by means of an air pump and a first conveyance means connected to said air pump to said Venturi means for the admixture of air and said blend of cement, passing the admixture to said transmission conduit, pumping compressed air by means of said air pump and a second conveyance means connected to said air pump to said transmission conduit for pushing and aiding the conveyance of the admixture of air and said blend of cement along said transmission conduit leading to the nozzle, and pumping compressed air by means of said air pump and a third conveyance means connected to said air pump to a vibrator element connected to said transmission conduit for driving said vibrator element to mechanically vibrate said transmission conduit.

* * * * *